US012509906B2

(12) United States Patent
Powell et al.

(10) Patent No.: US 12,509,906 B2
(45) Date of Patent: Dec. 30, 2025

(54) WRAP AROUND PLATES

(71) Applicant: Simpson Strong-Tie Company Inc., Pleasanton, CA (US)

(72) Inventors: Gregory S. Powell, Paso Robles, CA (US); Sam Thomas Hensen, Pleasanton, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 17/733,916

(22) Filed: Apr. 29, 2022

(65) Prior Publication Data

US 2023/0349192 A1 Nov. 2, 2023

(51) Int. Cl.
*E04H 17/00* (2006.01)
*E04H 12/22* (2006.01)

(52) U.S. Cl.
CPC ..... *E04H 17/006* (2021.01); *E04H 12/2292* (2013.01)

(58) Field of Classification Search
CPC ..... E04H 12/2292; E04H 17/006
See application file for complete search history.

(56) References Cited

U.S. PATENT DOCUMENTS 5,315,796 A 5/1994 Gruhlke
5,503,371 A 4/1996 Bies
5,794,395 A 8/1998 Reed
6,073,416 A * 6/2000 Peter ..... E04H 12/2292 52/298
6,098,353 A 8/2000 Stanfield
6,176,062 B1 1/2001 Fayle
6,389,760 B1 5/2002 McDonnell
D521,656 S 5/2006 Terrels
7,104,525 B2 * 9/2006 Ricci ..... E04H 12/2292 47/32.4
7,325,790 B2 2/2008 Lee
7,444,787 B2 11/2008 Cutforth
7,851,702 B2 * 12/2010 Fournier ..... H02G 3/081 174/559
7,866,120 B2 * 1/2011 Prenn ..... E01F 15/141 52/844
7,908,821 B2 * 3/2011 Prenn ..... E04F 11/1814 52/844
8,322,114 B2 12/2012 Waters et al.
8,887,452 B2 * 11/2014 Carhart ..... E04H 12/2292 52/848
8,966,837 B2 3/2015 Knudsen
(Continued)

FOREIGN PATENT DOCUMENTS

GB 2 132 305 A 7/1984
WO WO 2006 122 894 11/2006

OTHER PUBLICATIONS

Simpson Strong-Tie Company Inc, Wood Construction Connectors 2019-2029, Jan. 1, 2019, pp. front cover, 314-326, back cover, C-C-2019, Simpson Strong-Tie Company, Inc., Pleasanton, California, USA.

*Primary Examiner* — Andrew J Triggs
(74) *Attorney, Agent, or Firm* — Charles R. Cypher

(57) ABSTRACT

A post cover that is formed from a plurality of separate pieces that are joined together by fastenings to make the cover where each piece is formed with a facing surface, the facing surface has a plurality of outer edges, and one or more peripheral flanges depend from one or more of the outer edges.

14 Claims, 26 Drawing Sheets

(56) References Cited

U.S. PATENT DOCUMENTS

| | | | | |
|---|---|---|---|---|
| 9,027,897 | B2 | 5/2015 | Hill | |
| D733,546 | S | 7/2015 | Balzhiser | |
| 9,085,915 | B1 | 7/2015 | Emmett | |
| 9,540,801 | B2 | 1/2017 | Hill | |
| D798,701 | S | 10/2017 | Hill | |
| D835,979 | S | 12/2018 | Lin | |
| 10,227,772 | B1 | 3/2019 | Oz-Post | |
| 10,316,538 | B2 | 6/2019 | Hill | |
| 10,450,759 | B1 * | 10/2019 | Carmody | E01F 15/141 |
| D898,559 | S | 10/2020 | Hill | |
| 11,795,726 | B2 | 10/2023 | Stinson, Sr. | |
| 2011/0302874 | A1 * | 12/2011 | Prenn | E01F 15/141 52/741.3 |
| 2013/0042547 | A1 * | 2/2013 | Carhart | E04H 12/2292 52/169.13 |
| 2016/0319564 | A1 | 11/2016 | Western | |
| 2019/0376308 | A1 | 12/2019 | Cindon | |

* cited by examiner

WRAP AROUND PLATES

BACKGROUND OF THE INVENTION

Field of the Invention

The present invention relates to the construction of embedded posts, and more particularly to an apparatus for wrapping around the bottom of a post. The apparatus consists of a plurality of separate plates joined to each other by fasteners to form a cover that encloses the base of the post above ground.

Description of the Prior Art

U.S. Pat. No. 5,503,371, invented by John Bies and granted in 1996 teaches placing a single-piece plastic cuff around the base of a wooden fence post above the ground to protect the fence post from damage by gardening tools.

U.S. Pat. No. 6,098,353, invented by Barney Stanfield and granted in 2000 teaches a protective sleeve for the post that is meant to protect the post from moisture. The sleeve encapsulates the bottom of the post below ground. The sleeve can be used with a multi-part cap that closely confirms to the shape of the post and surrounds the post to prevent the entry of water into the sleeve. The parts of the cap are joined by a bolt in one part joining with a nut received in another part.

U.S. Pat. No. 6,176,062 invented by Michael J. Fayle and granted in 2001 teaches wrapping the base of a post above ground with an impact-absorbing material and then a protective material to protect the base of the post from impacts. The materials are fastened to the post by a fastener that passes through the materials and enters the post.

U.S. Pat. No. 9,027,897 and 10, 316, 538, filed by Ian A. Hill and granted in 2015 and 2019, respectively, teach a stand-off post base formed with a plate set under the post and separable stirrup plates that engage the sides of the post and connect to the plate. The stirrup plates have slots that engage tabs on the base plate and when the connection is made the tabs of the base plate are inserted into slots in the stirrup plates. The stirrup plates have decorative features. US Design Patents 798,701 and 898,559, also filed by Ian A. Hill, and granted in 2017 and 2020, respectively, teach forming structural connectors with decorative designs that look like a nut attached to a bolt with a round washer disposed at the base of the nut.

The present invention provides a cover for a post that is made from separate pieces joined to each other in a manner that is easy to assemble and has an attractive appearance.

SUMMARY OF THE INVENTION

The present invention provides a post cover that is formed from a plurality of separate pieces that are joined together by fastenings to make the cover. Each piece is formed with a facing surface, the facing surface has a plurality of outer edges, and one or more peripheral flanges depend from one or more of the outer edges.

According to the present invention, each piece has a longitudinal axis that is oriented vertically when the cover is formed around a vertically oriented post, and each piece has first and second opposed side edges that bracket the longitudinal axis. According to the present invention, each side edge of each piece is formed to mate with a corresponding side edge of an adjacent piece. In one preferred embodiment for a post made with four side faces and having a generally square cross-section, the cover is made from four pieces with each piece being of generally equal size. The four pieces are a set of two pairs of pieces. The pieces in the first pair are designed to be disposed opposite each other and the pieces in the second pair are designed to be disposed opposite each other. The pieces in the first pair have encapsulating portions formed at their side edges. The pieces in the second have pair have insertion portions formed at their side edges that are designed to be inserted into the encapsulating portions of the pieces of the first pair to interconnect the pieces and form the cover.

According to the present invention, each piece is also formed with a top edge and an opposed bottom edge, with the top edge being disposed above the bottom edge when the longitudinal axis is disposed vertically. According to the present invention, a depending portion is formed at or near the top edge of each piece to hold the piece away from the side surface of the post to which it is adjacent. In the preferred form of the invention, the depending portion is a depending peripheral flange formed along the top edge of the piece. In the preferred form of the invention the pieces are rigidly connected to each other by means of the insertion portions being inserted into the encapsulating portions. Due to the rigid connection of the pieces the pieces do not need to be supported by the post and can for the most part be spaced away from the post and still form a rigid encapsulating member.

According to the present invention the bottom edge of each piece is held away from the side surface of the post when the pieces are connected together around the post to form the cover. In the preferred embodiment, the bottom edge is formed with a peripheral flange that does not extend away from the facing surface of the piece as much as the top flange.

According to the present invention, the side edges of the pieces are disposed such that there is space between the corners of the post between the side surfaces of the post and the interfaces of the side edges of mating pieces.

DETAILED DESCRIPTION OF THE INVENTION

Figure 1:
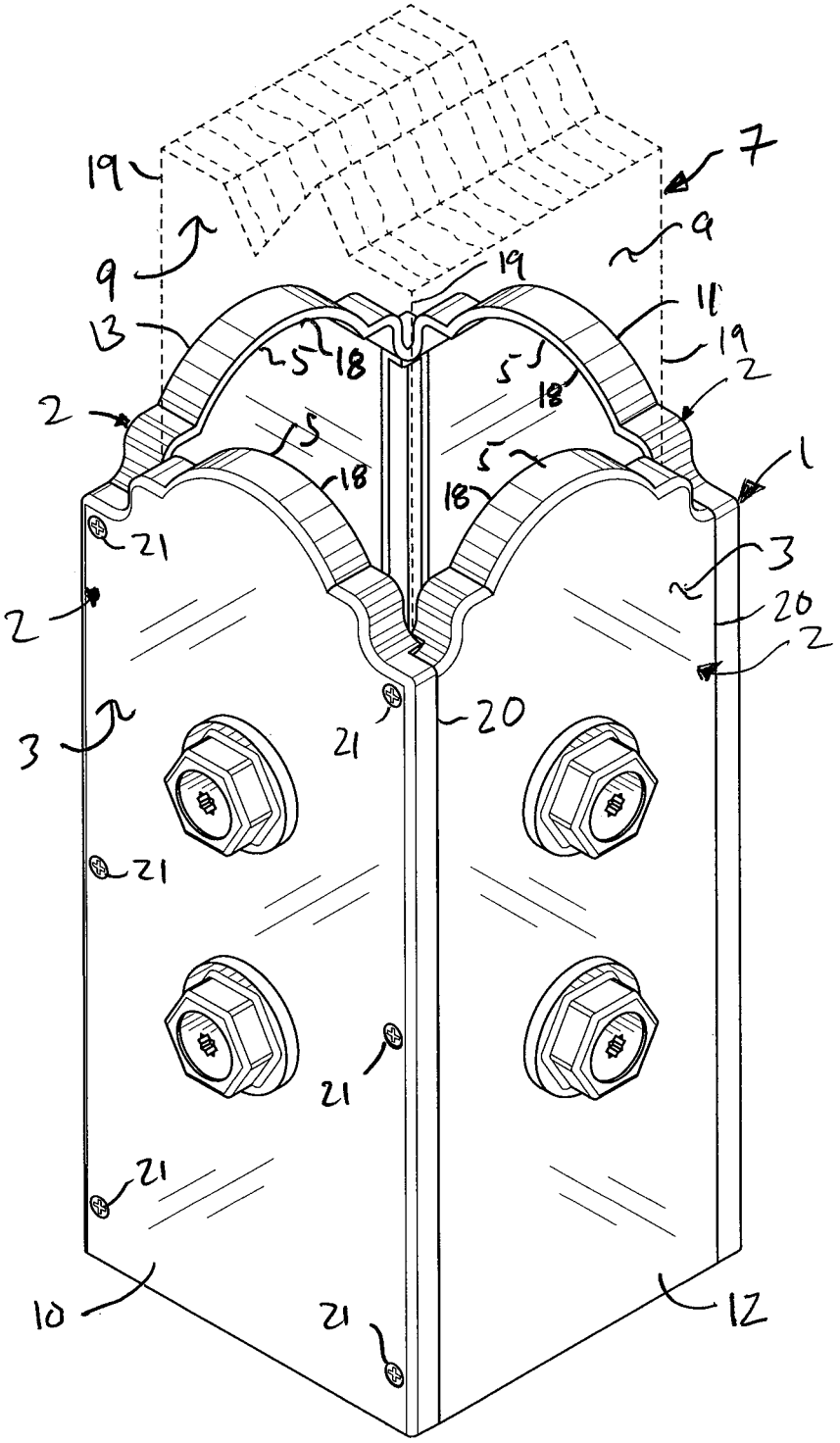
FIG. 1 is a perspective view of a cover made according to the present invention fitted over a post shown in dotted lines so that the interface of two of the pieces may be shown.
Figure 2:
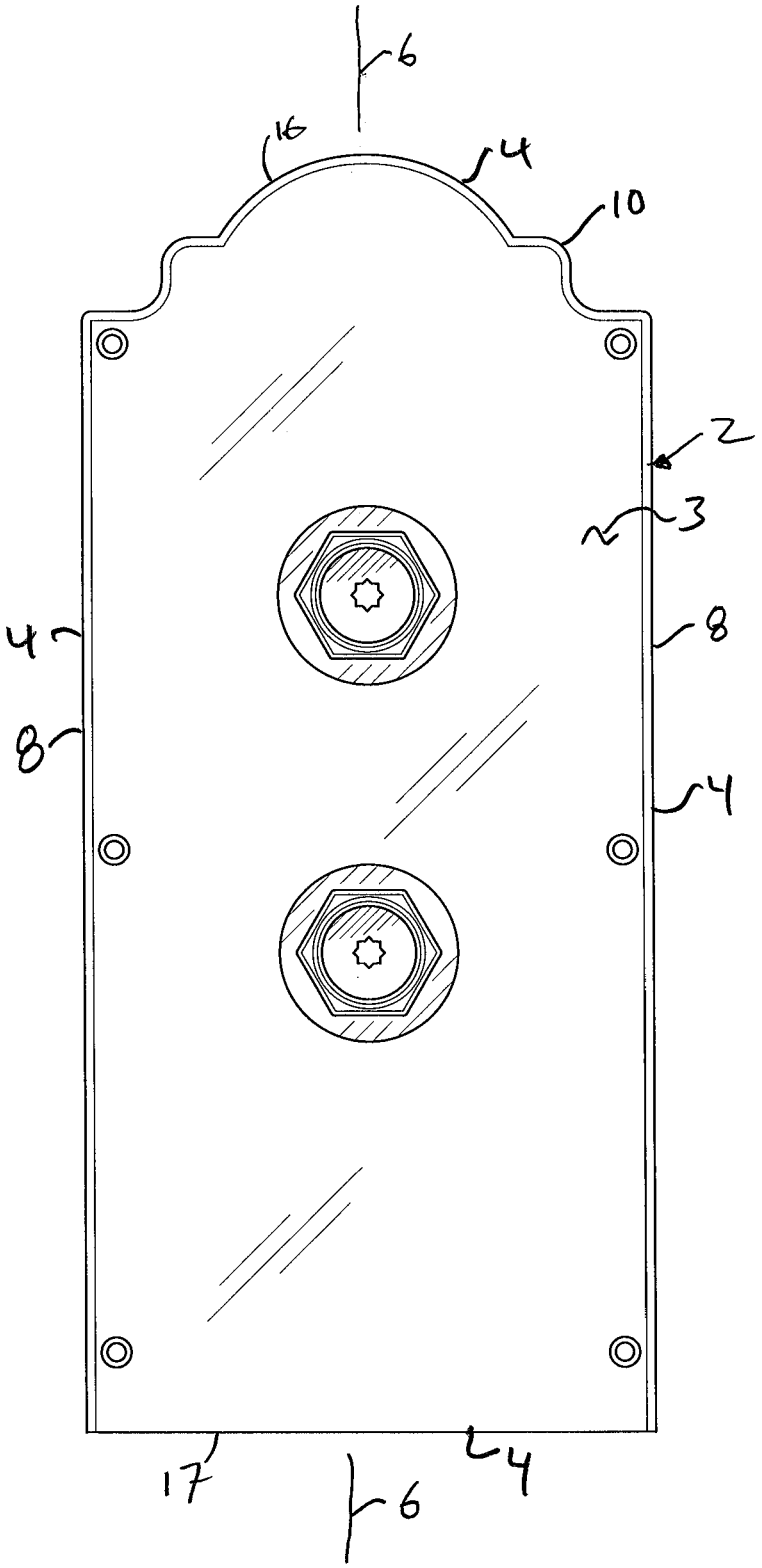
FIG. 2 is a front view of an encapsulating piece of a cover of the present invention.
Figure 3:
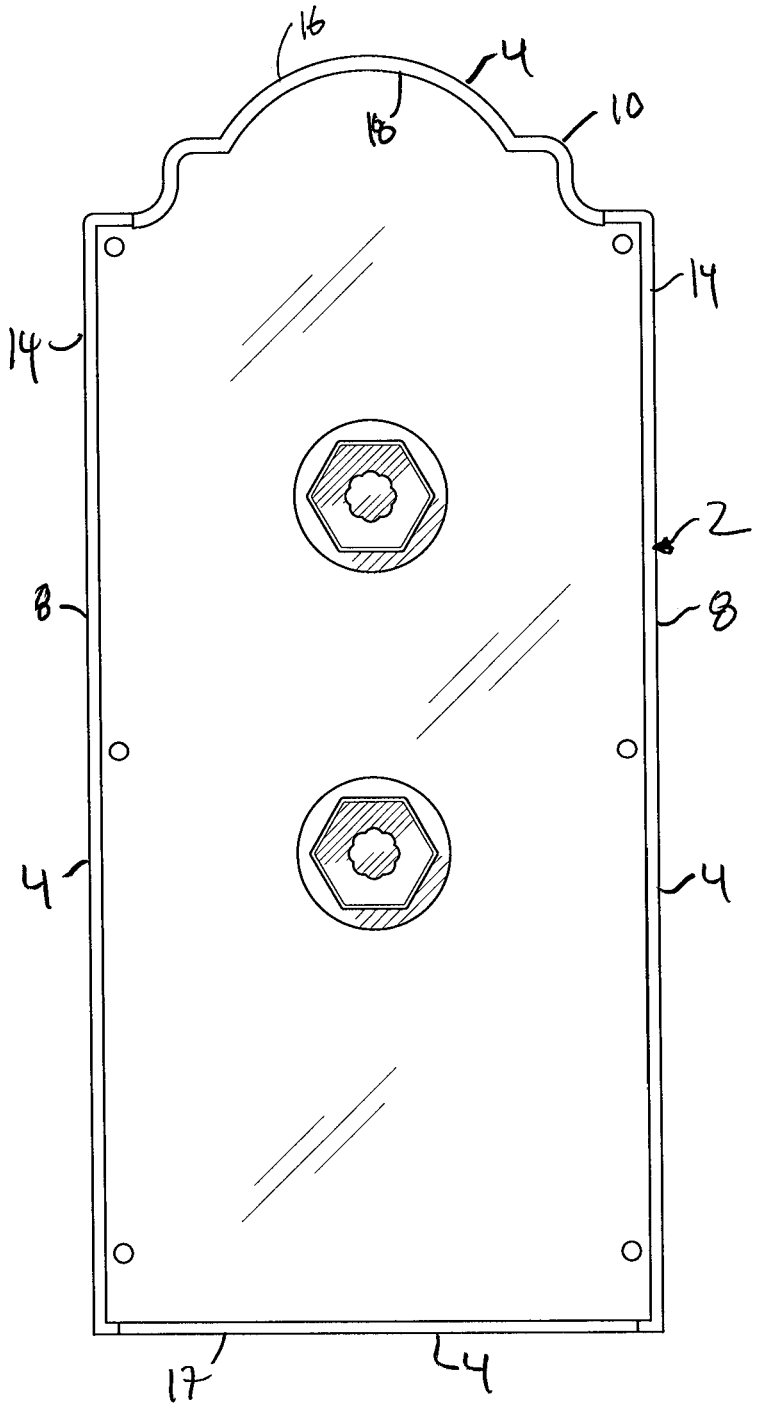
FIG. 3 is a back view of an encapsulating piece of a cover of the present invention.
Figure 4:
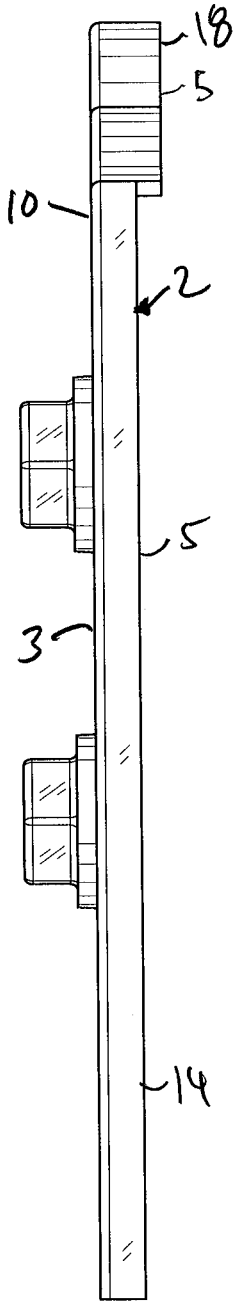
FIG. 4 is right side view of an encapsulating piece of a cover of the present invention.
Figure 5:
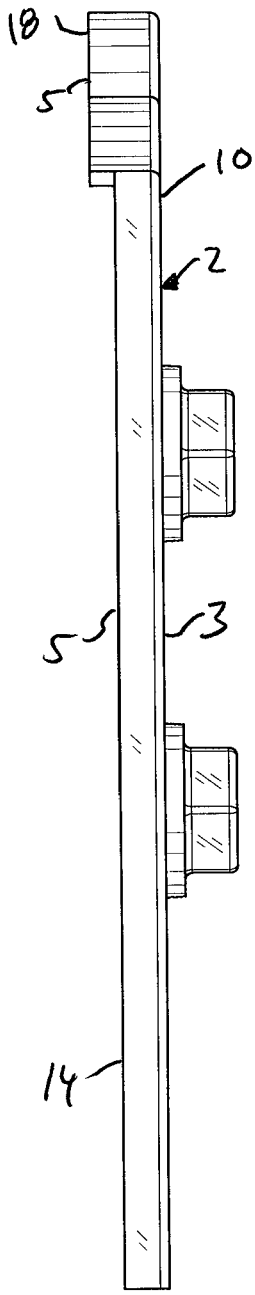
FIG. 5 is left side view of an encapsulating piece of a cover of the present invention
Figure 6:
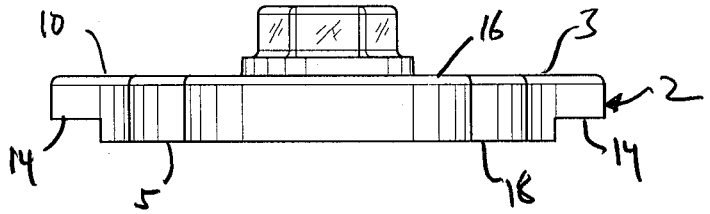
FIG. 6 is a top view of an encapsulating piece of a cover of the present invention.
Figure 7:
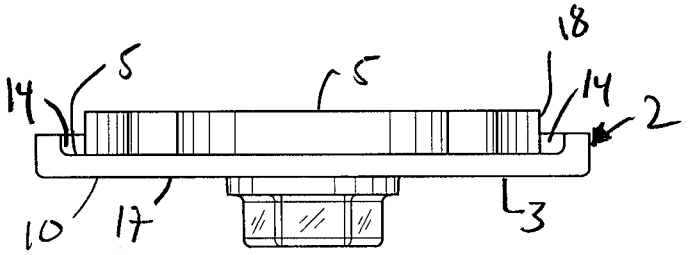
FIG. 7 is bottom view of an encapsulating piece of a cover of the present invention.
Figure 8:
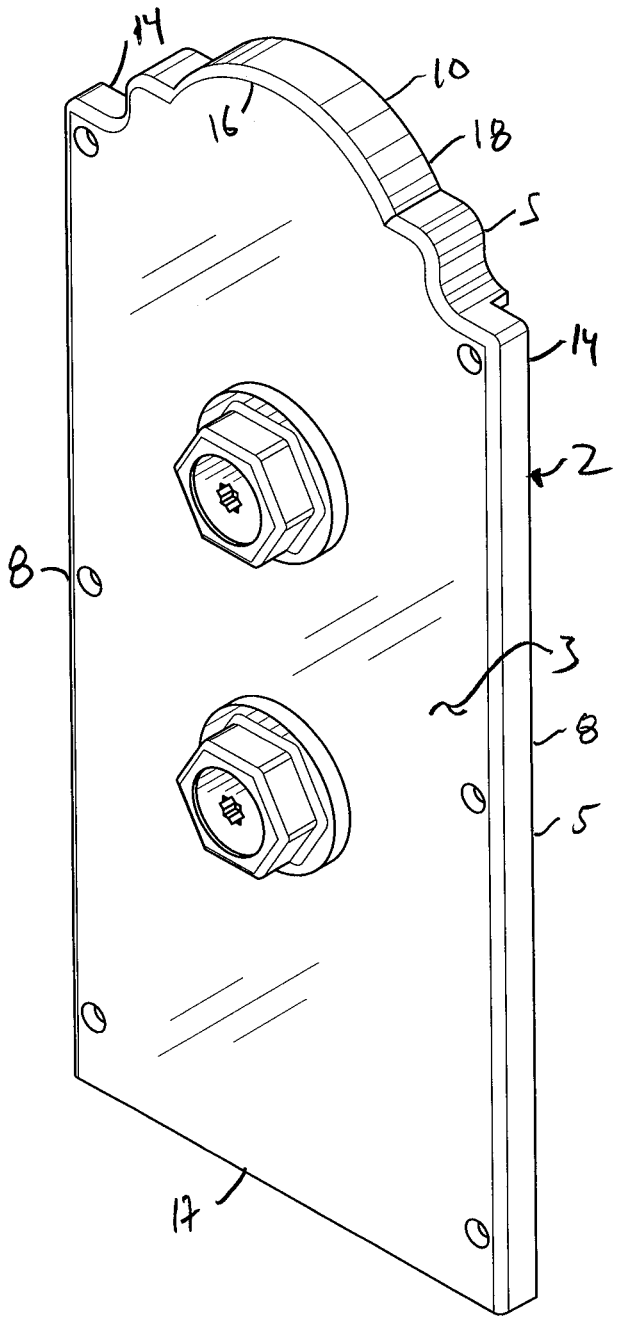
FIG. 8 is a front, perspective view of an encapsulating piece of a cover of the present invention.
Figure 9:
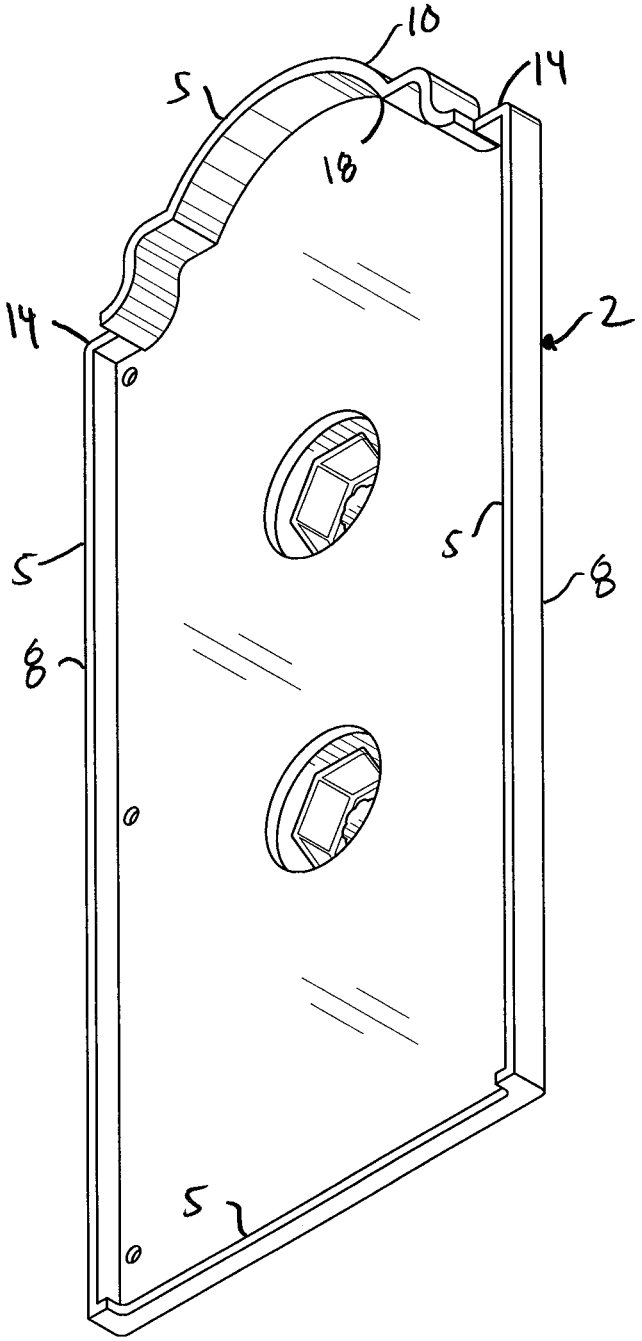
FIG. 9 is a back perspective view of an encapsulating piece of a cover of the present invention.
Figure 10:
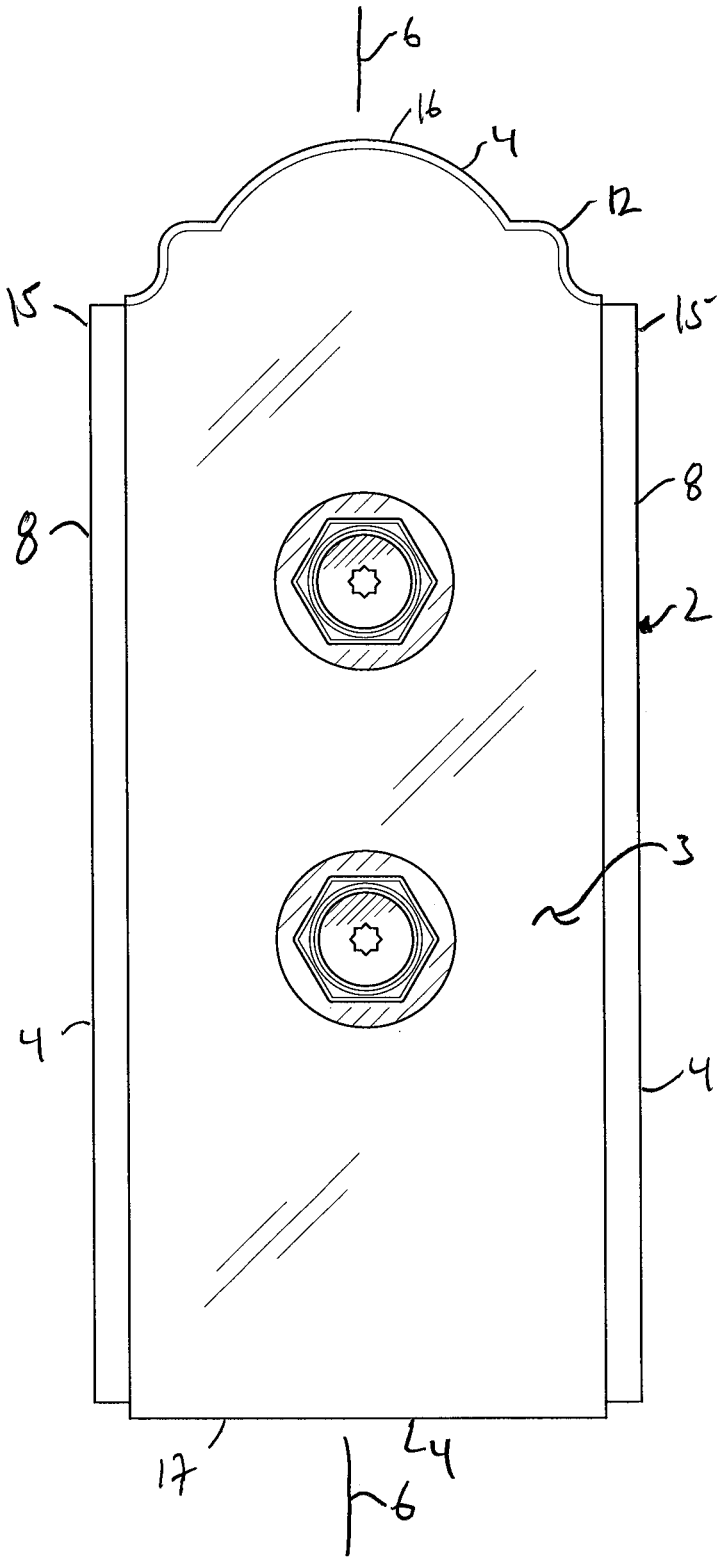
FIG. 10 is a front view of an inserting piece of a cover of the present invention.
Figure 11:
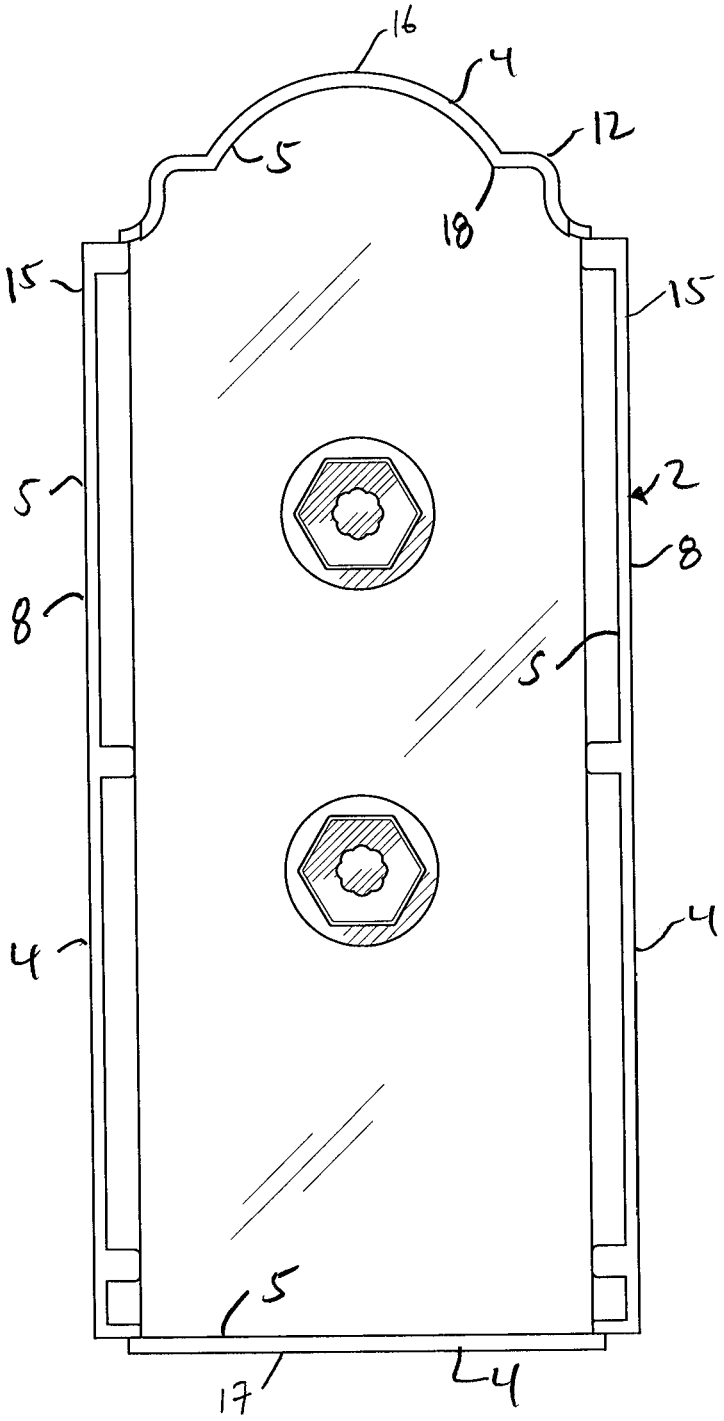
FIG. 11 is a back view of an inserting piece of a cover of the present invention.
Figure 12:
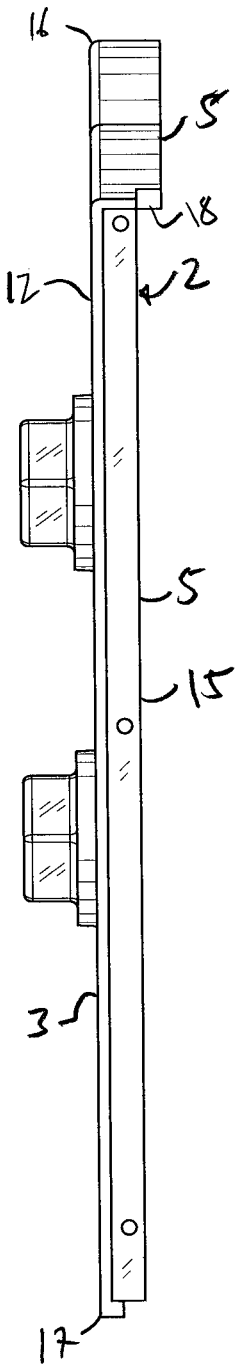
FIG. 12 is right side view of an inserting piece of a cover of the present invention.
Figure 13:
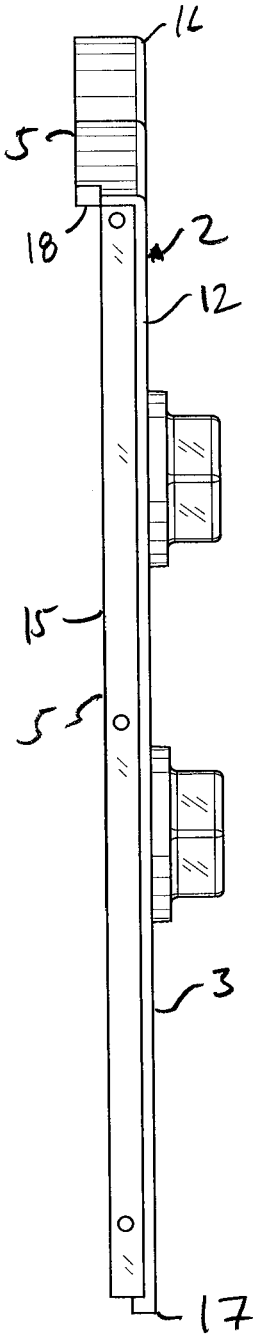
FIG. 13 is left side view of an inserting piece of a cover of the present invention
Figure 14:
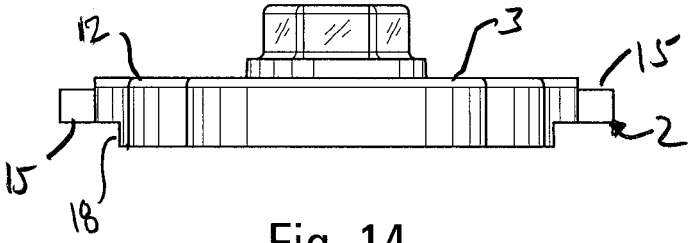
FIG. 14 is a top view of an inserting piece of a cover of the present invention.
Figure 15:
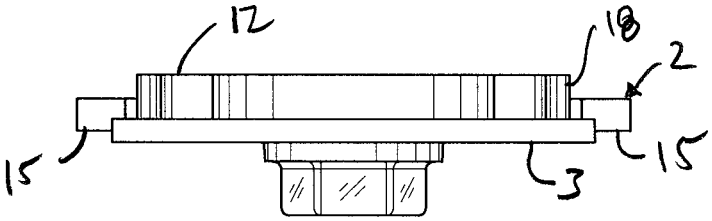
FIG. 15 is bottom view of an inserting piece of a cover of the present invention.
Figure 16:
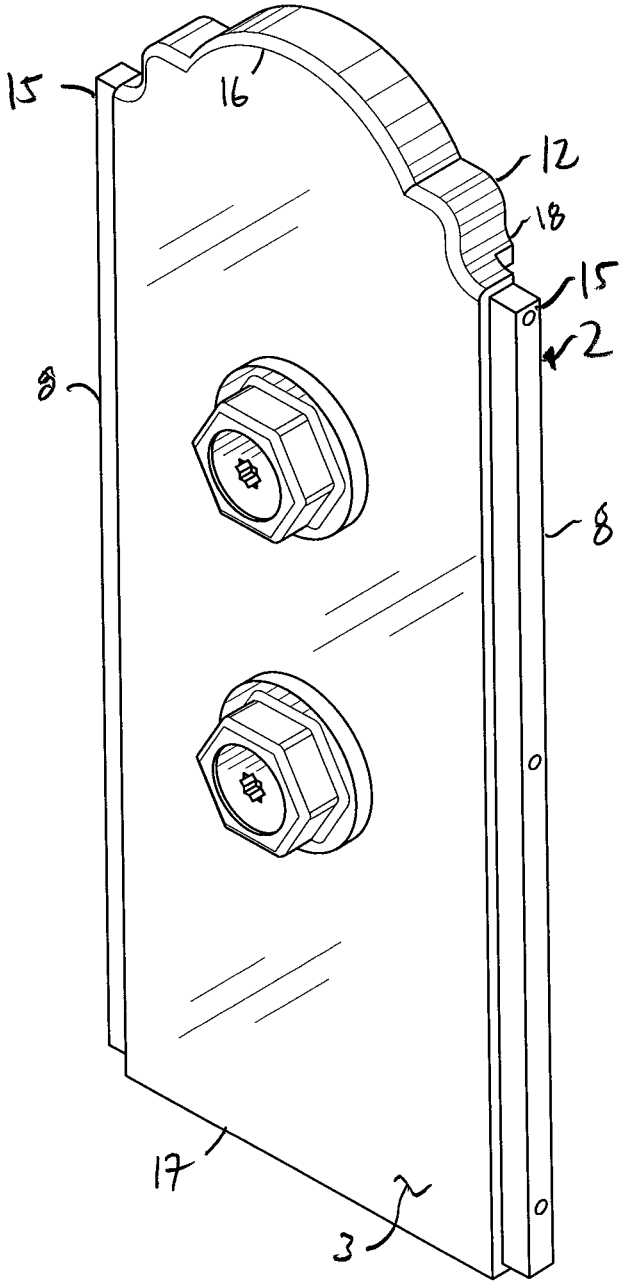
FIG. 16 is a front, perspective view of an inserting piece of a cover of the present invention.
Figure 17:
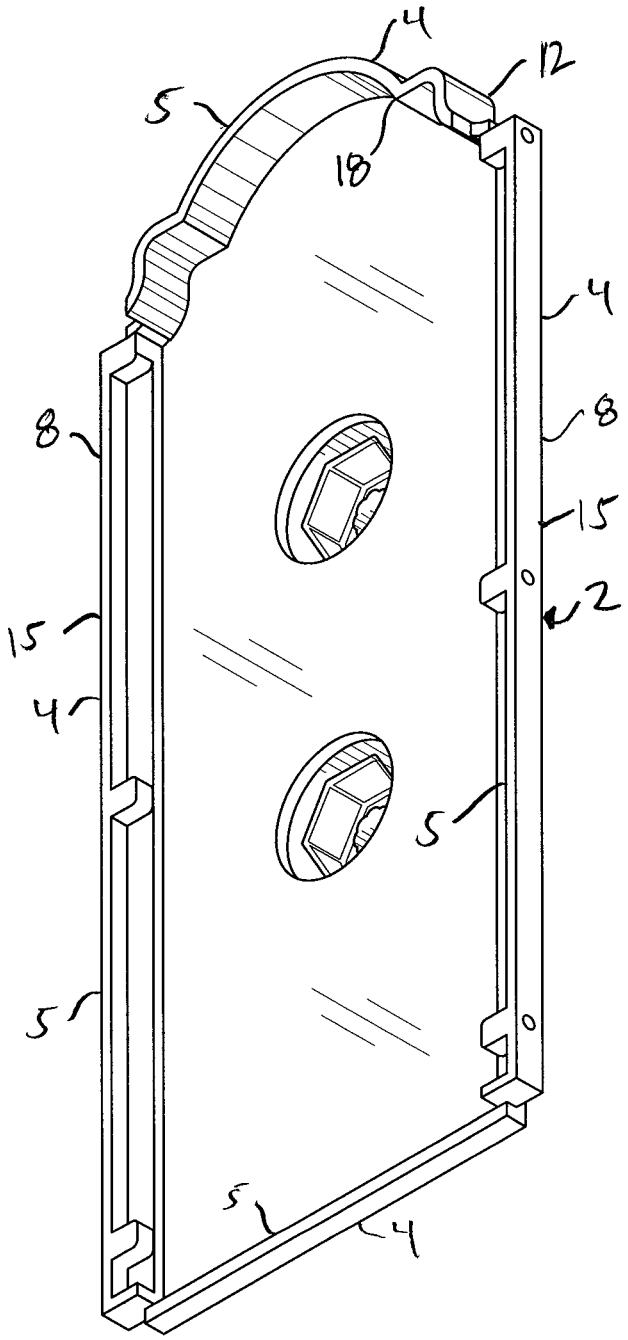
FIG. 17 is a back perspective view of an inserting piece of a cover of the present invention.
Figure 18:
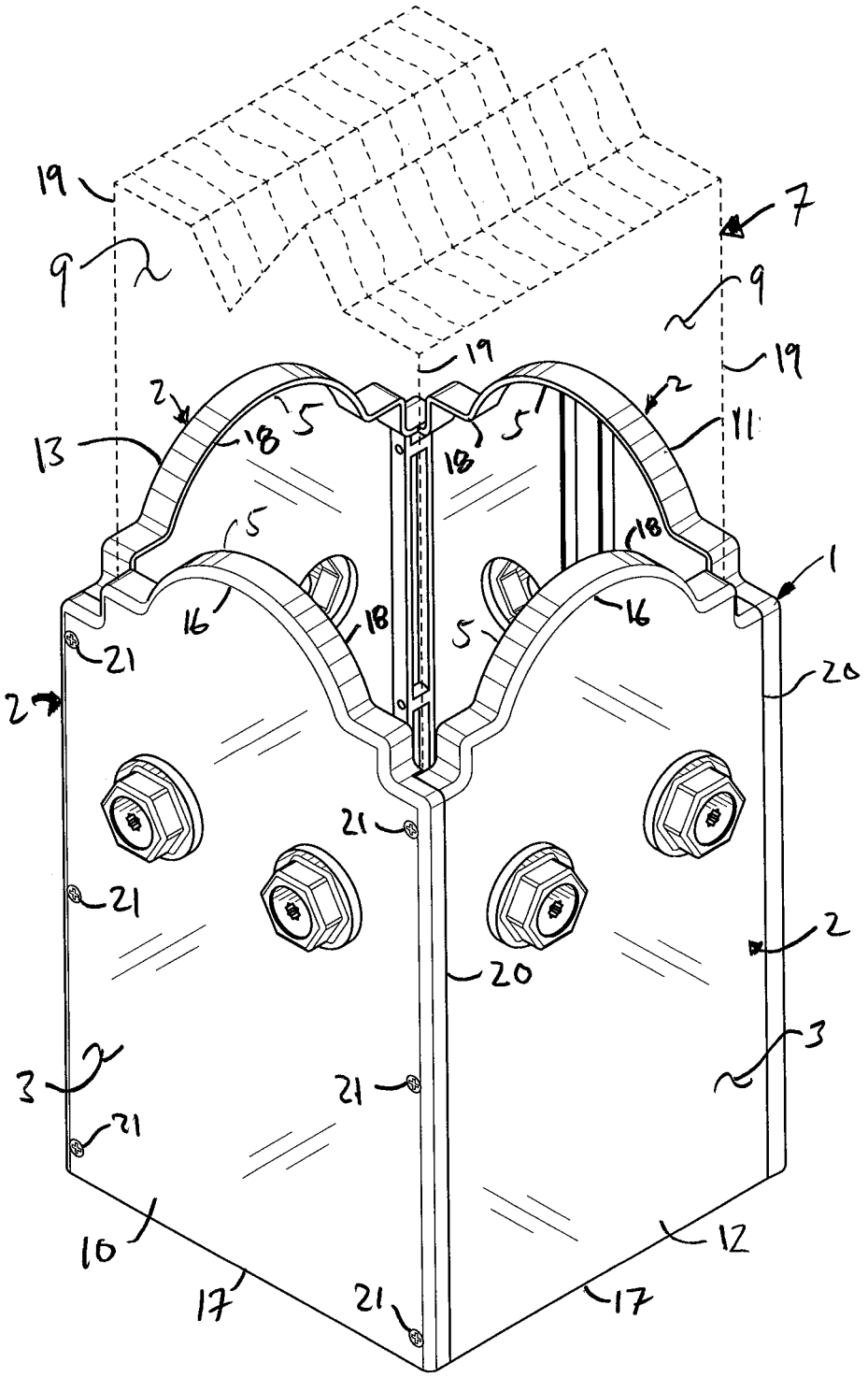
FIG. 18 is a perspective view of a cover made according to the present invention fitted over a post shown in dotted lines so that the interface of two of the pieces may be shown. The post and cover shown in FIG. 18 is larger than the post and cover shown in FIG. 1.
Figure 19:
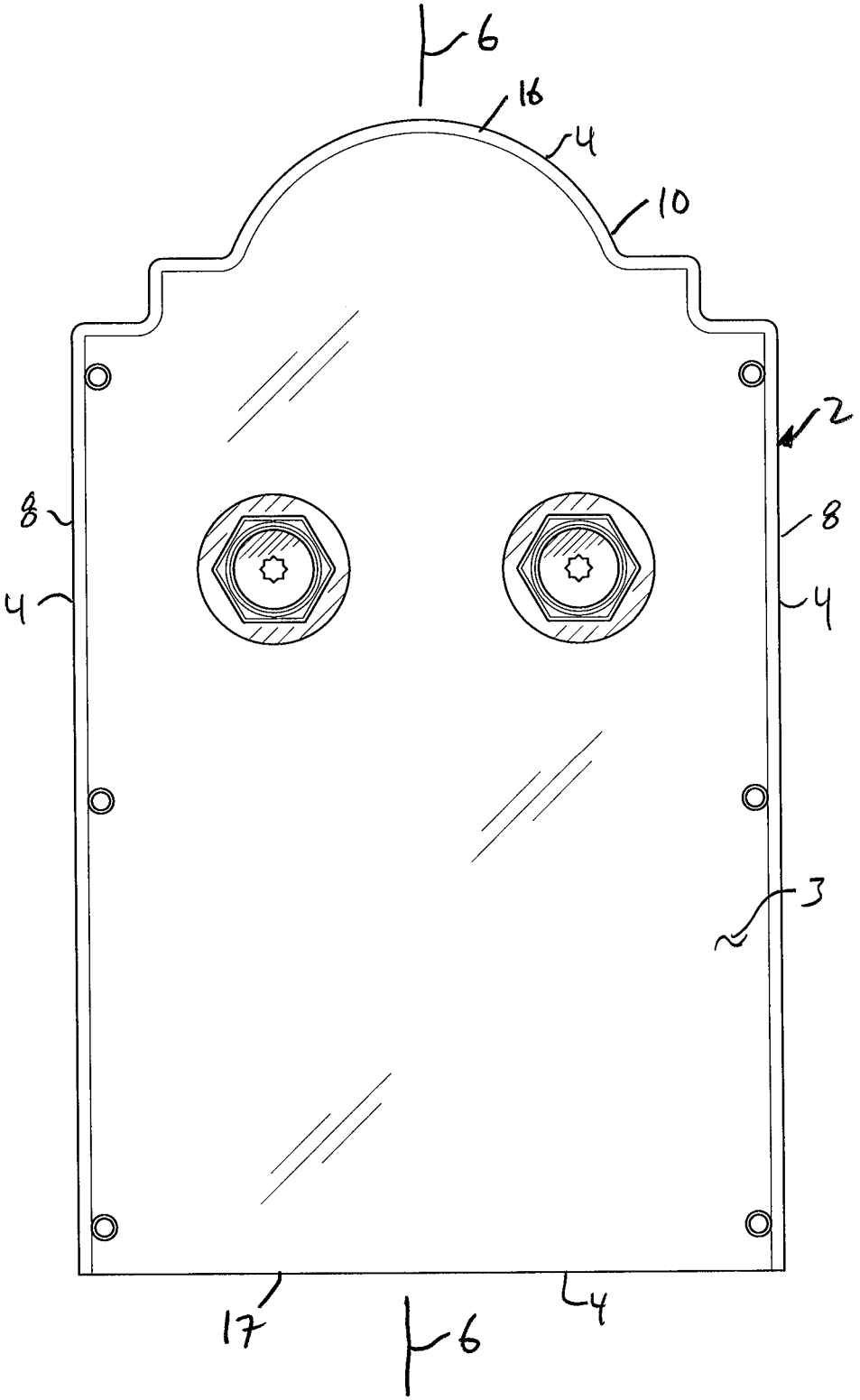
FIG. 19 is a front view of an encapsulating piece of a cover of the present invention.
Figure 20:
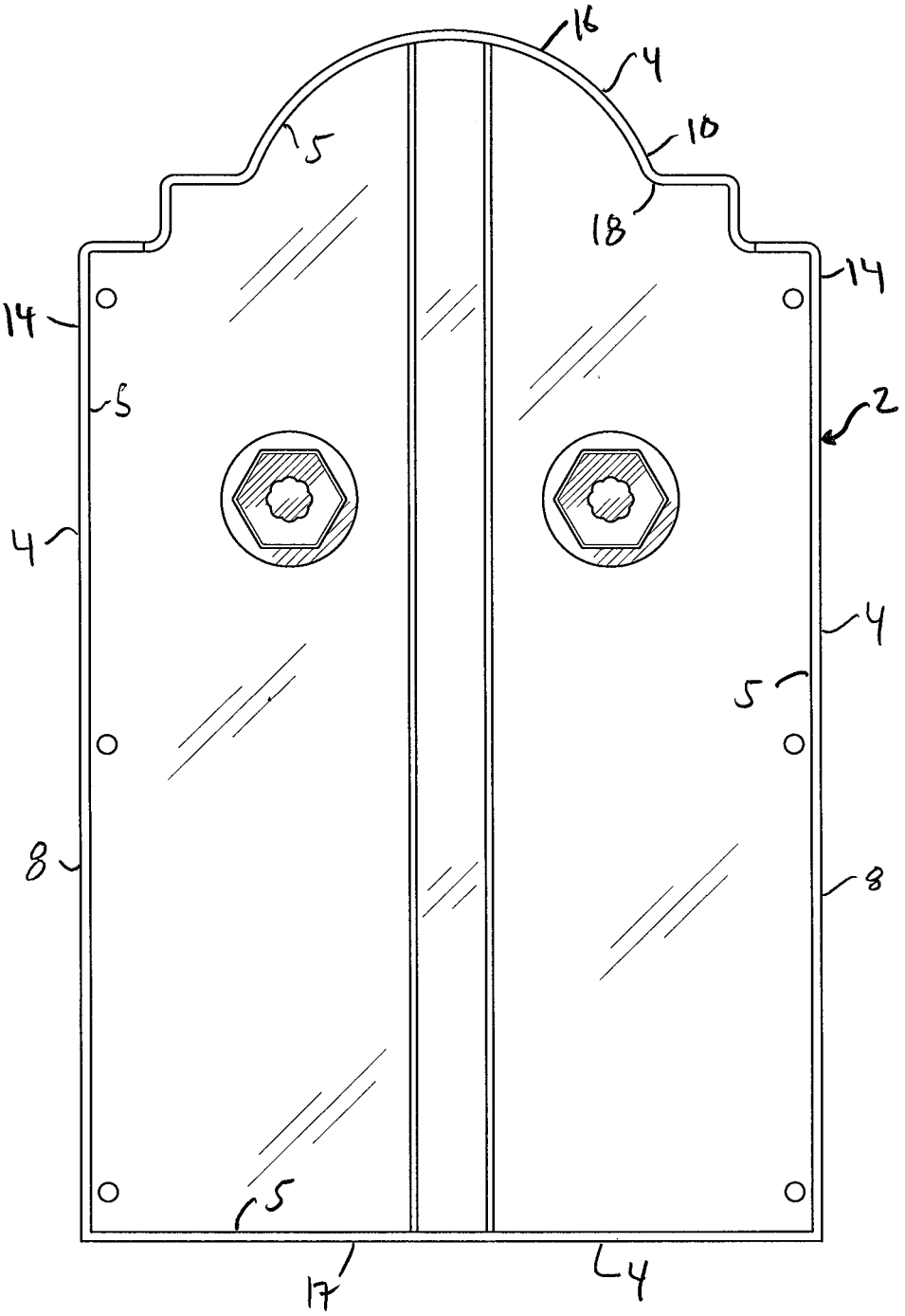
FIG. 20 is a back view of an encapsulating piece of a cover of the present invention.
Figure 21:
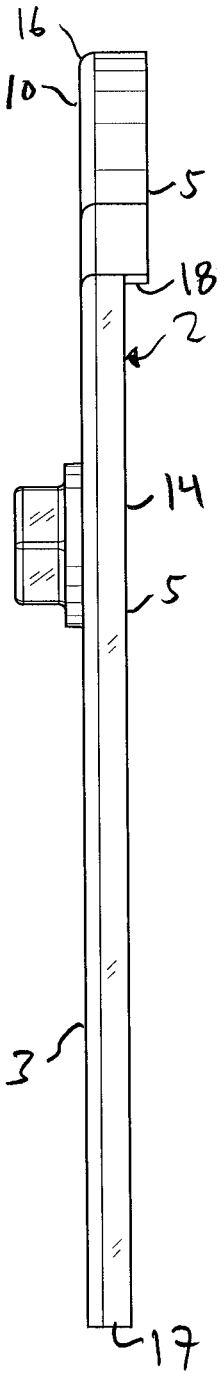
FIG. 21 is right side view of an encapsulating piece of a cover of the present invention.
Figure 22:
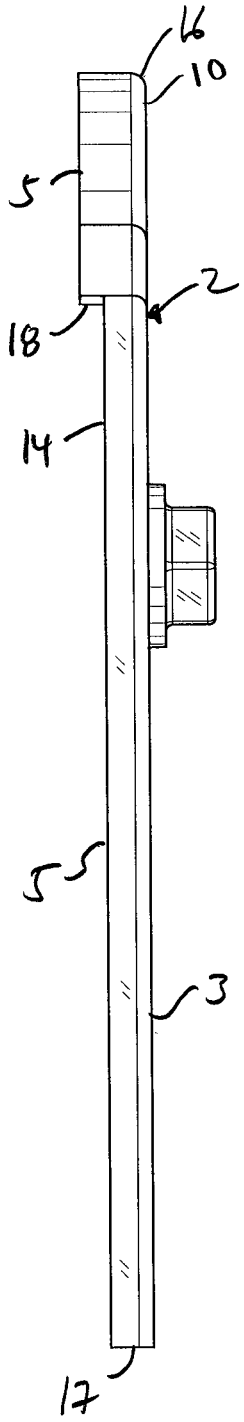
FIG. 22 is left side view of an encapsulating piece of a cover of the present invention
Figure 23:
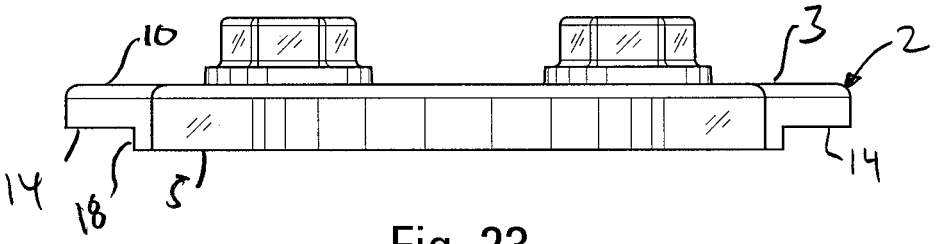
FIG. 23 is a top view of an encapsulating piece of a cover of the present invention.
Figure 24:
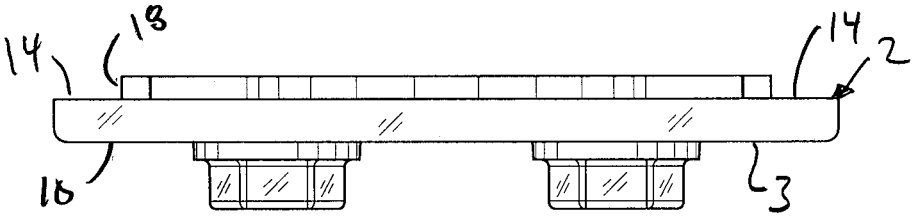
FIG. 24 is bottom view of an encapsulating piece of a cover of the present invention.
Figure 25:
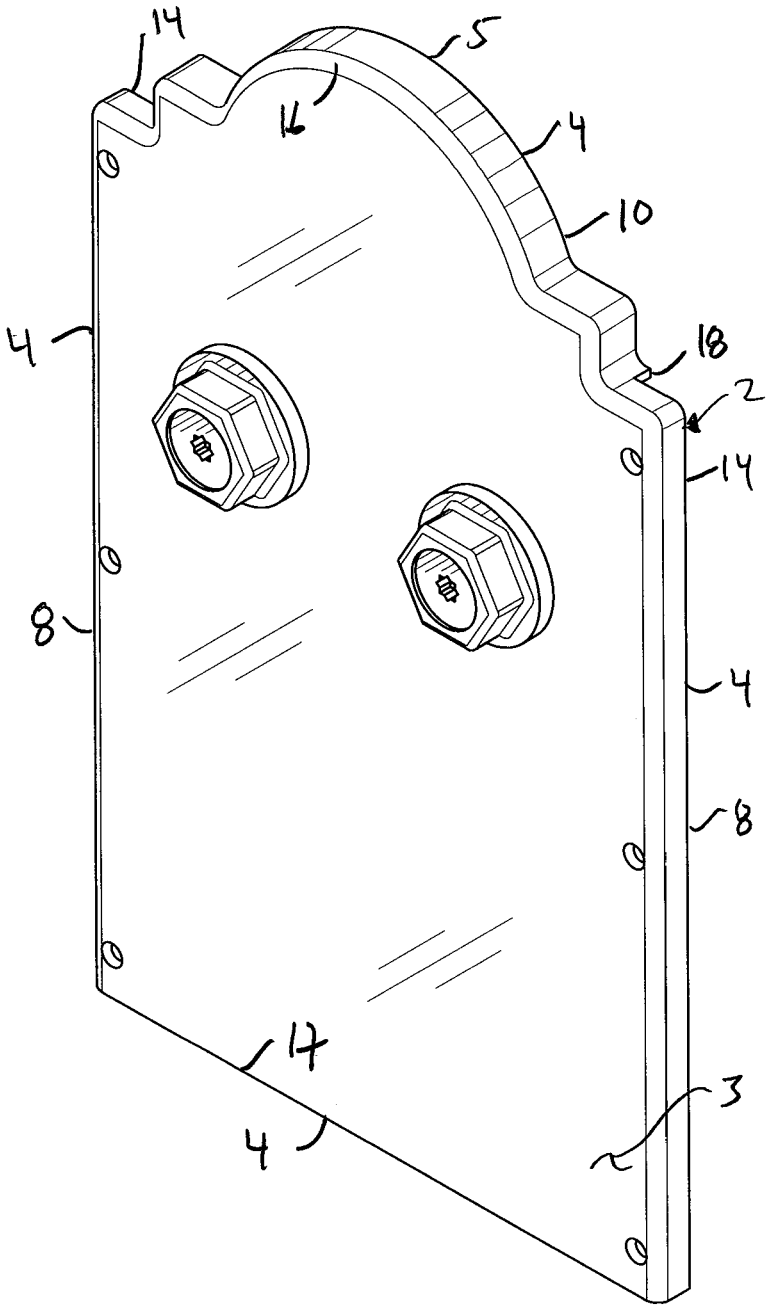
FIG. 25 is a front, perspective view of an encapsulating piece of a cover of the present invention.
Figure 26:
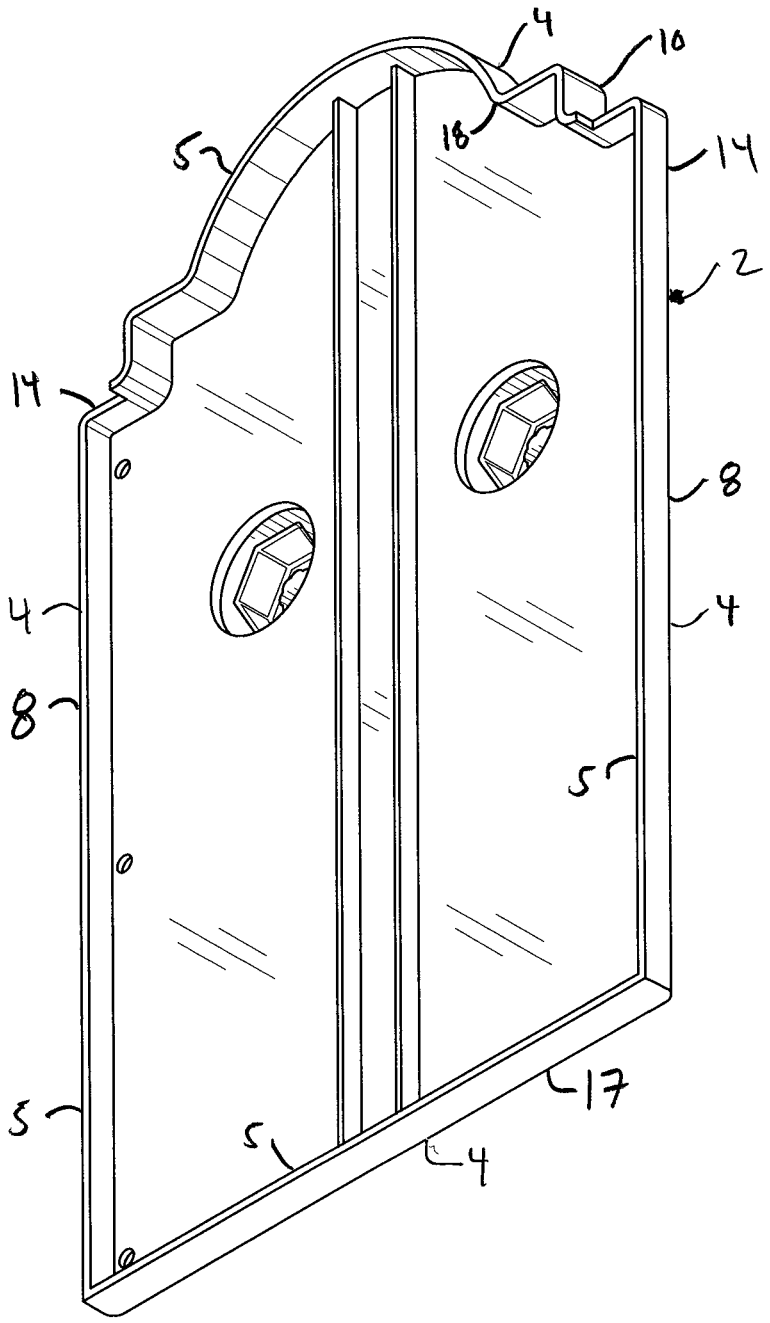
FIG. 26 is a back perspective view of an encapsulating piece of a cover of the present invention.
Figure 27:
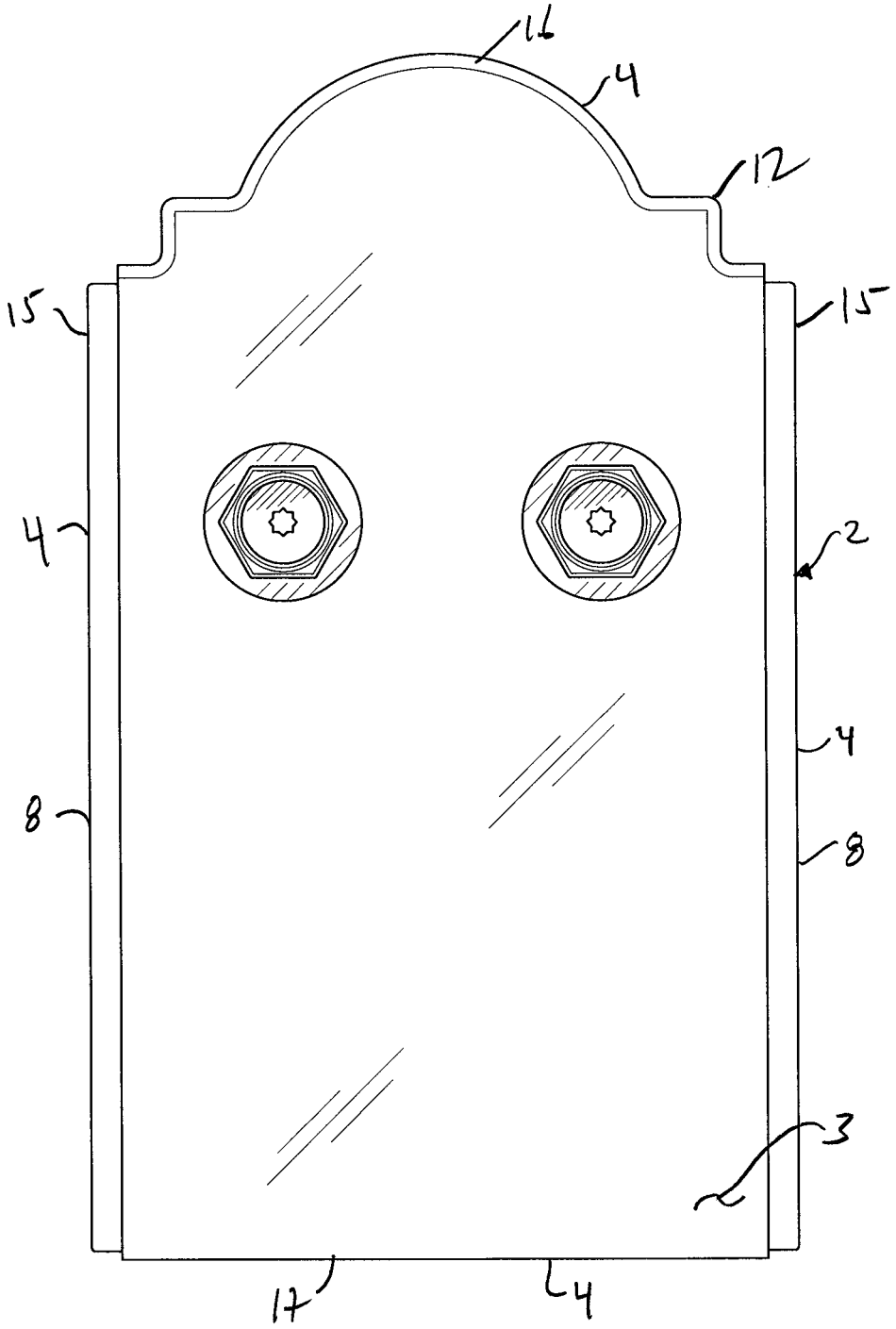
FIG. 27 is a front view of an inserting piece of a cover of the present invention.
Figure 28:
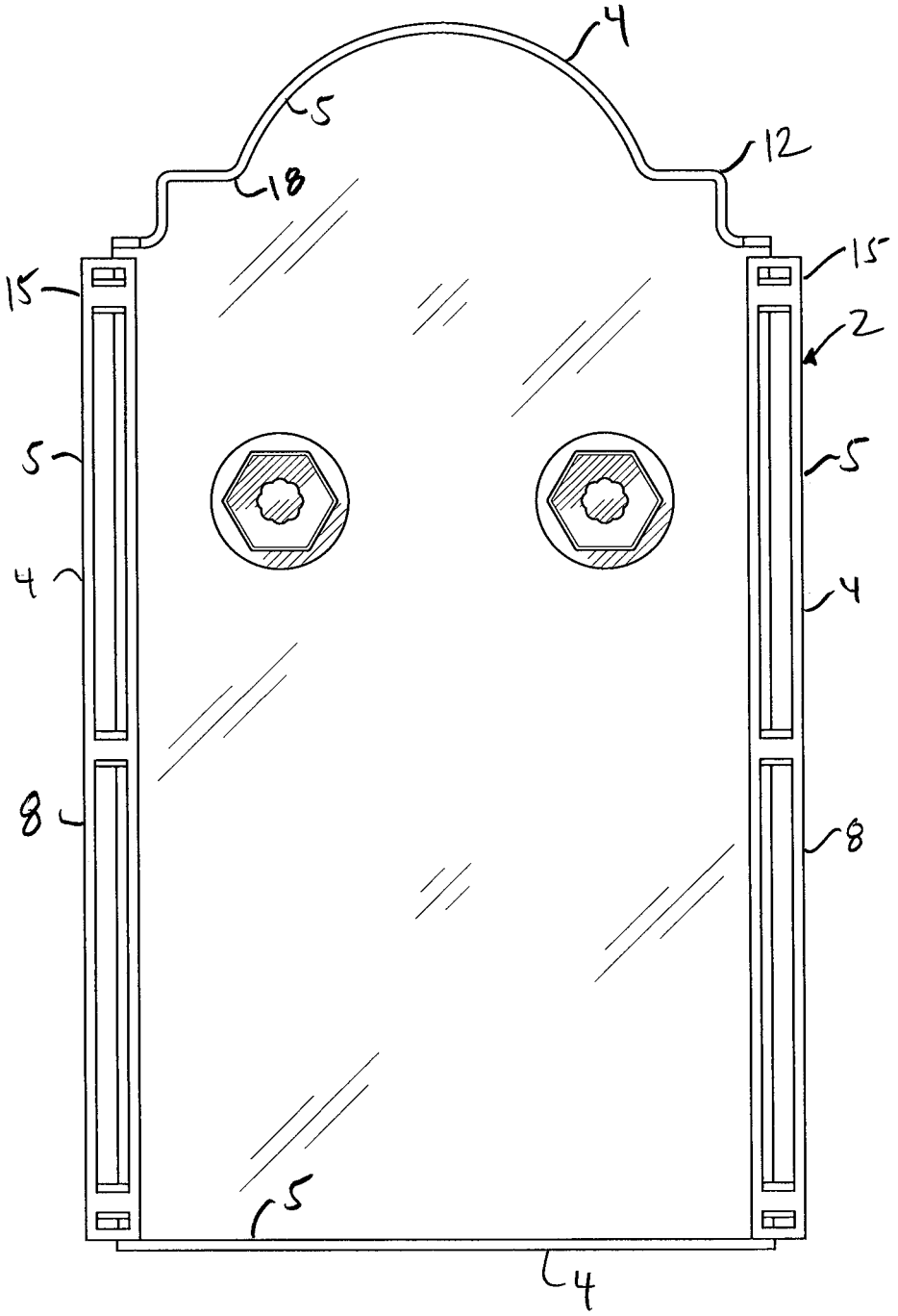
FIG. 28 is a back view of an inserting piece of a cover of the present invention.
Figure 29:
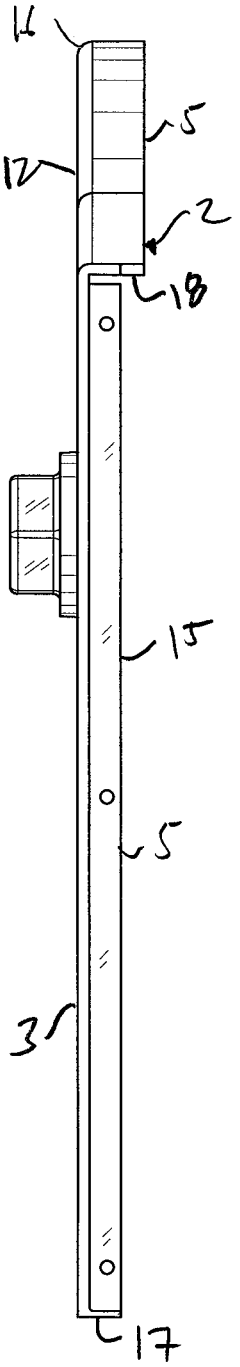
FIG. 29 is right side view of an inserting piece of a cover of the present invention.
Figure 30:
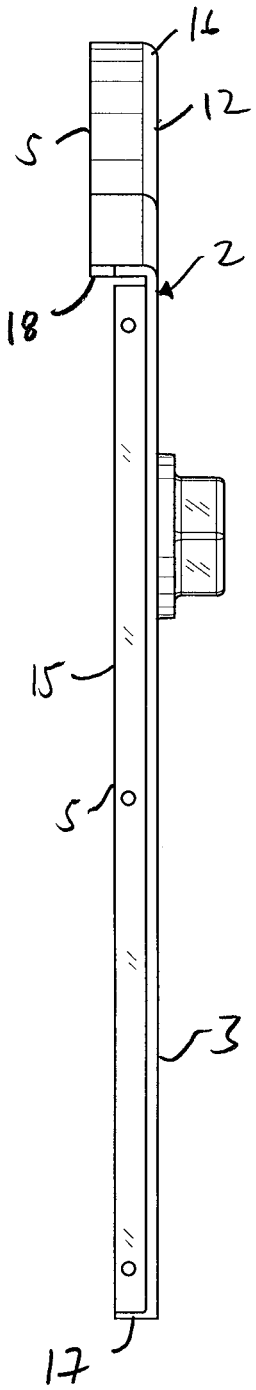
FIG. 30 is left side view of an inserting piece of a cover of the present invention
Figure 31:
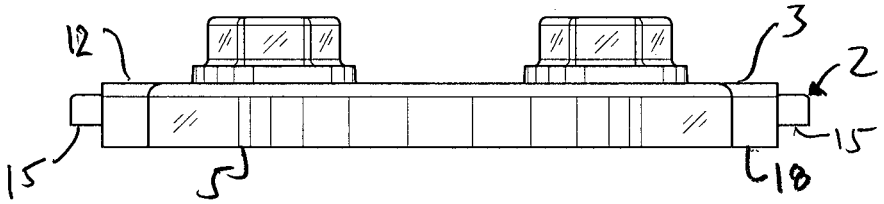
FIG. 31 is a top view of an inserting piece of a cover of the present invention.
Figure 32:
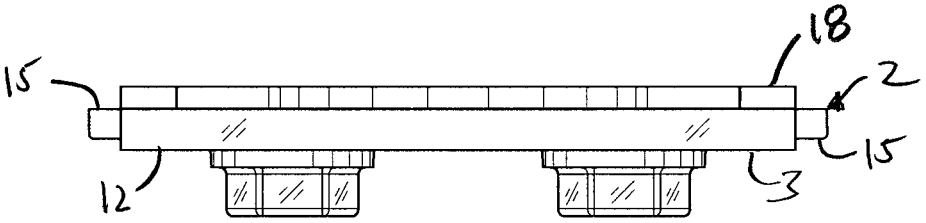
FIG. 32 is bottom view of an inserting piece of a cover of the present invention.
Figure 33:
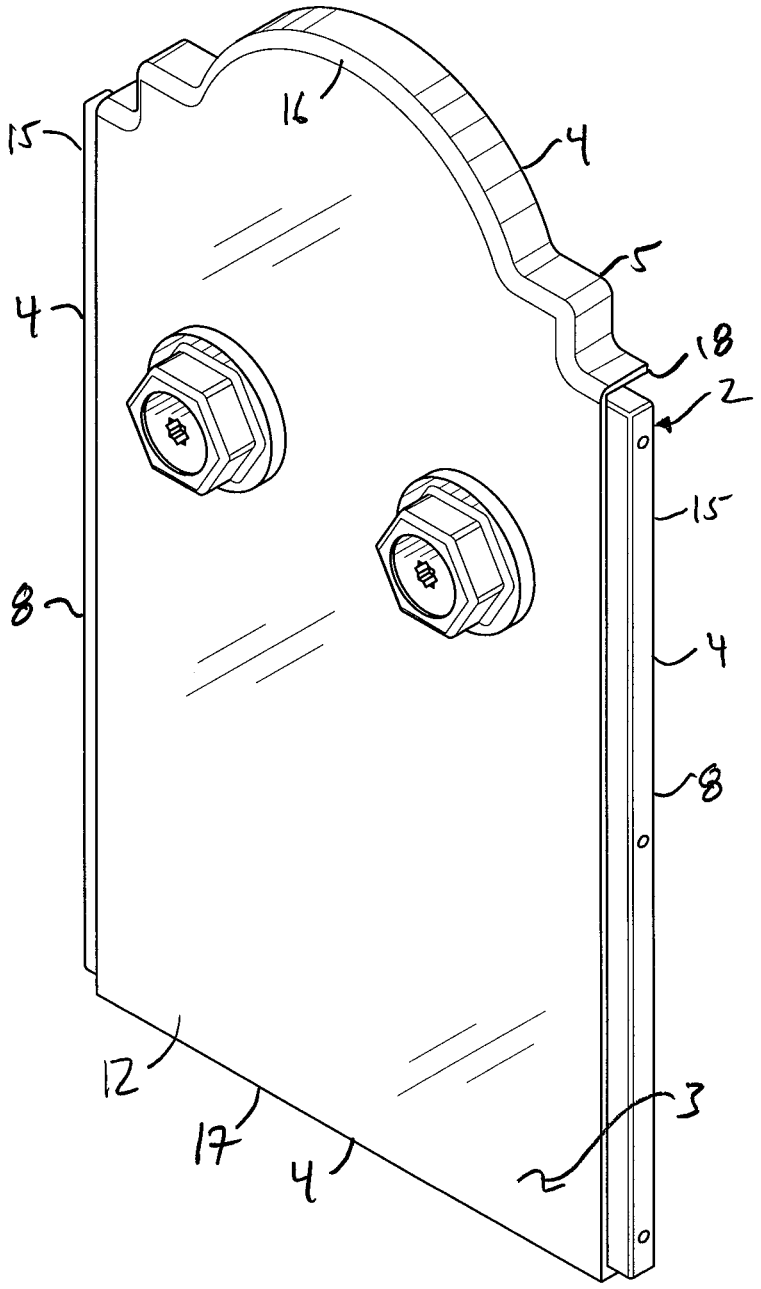
FIG. 33 is a front, perspective view of an inserting piece of a cover of the present invention.
Figure 34:
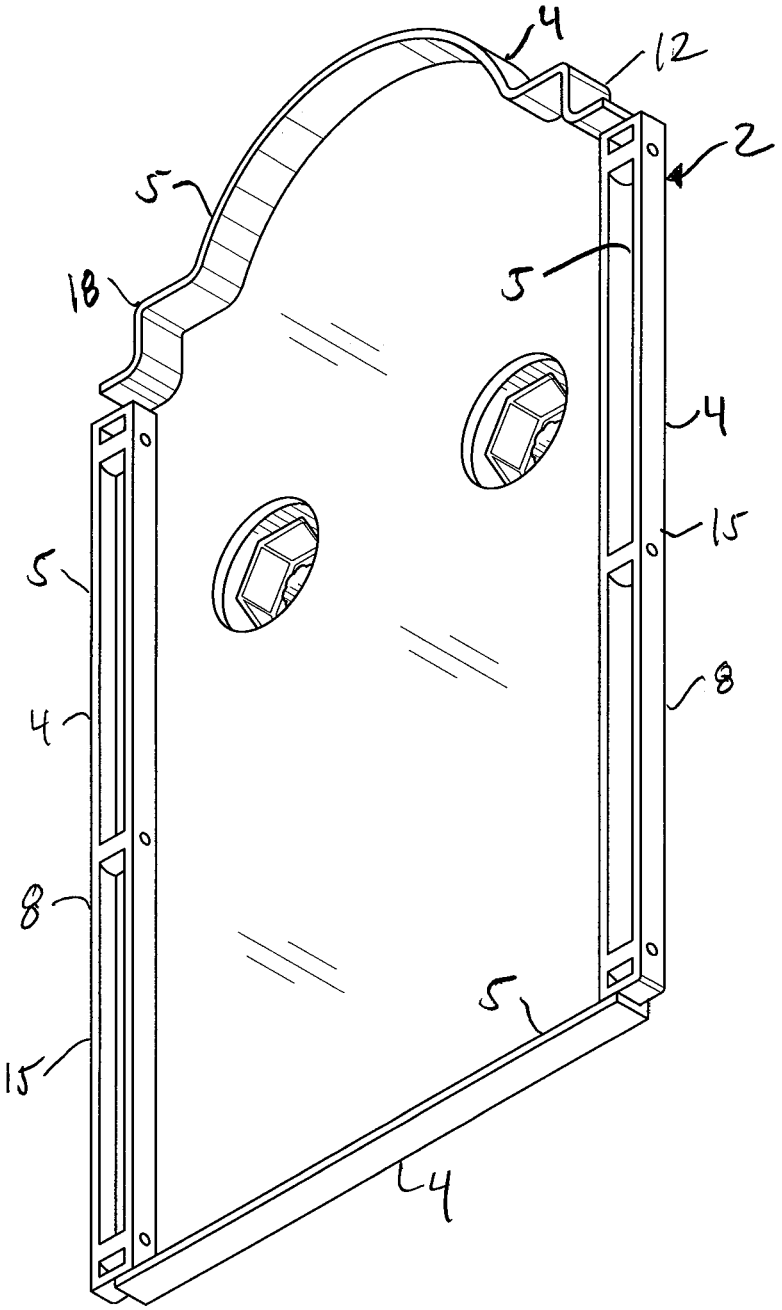
FIG. 34 is a back perspective view of an inserting piece of a cover of the present invention.

As shown in FIG. 1, the present invention consists of a cover 1 that is formed from a plurality of separate pieces 2 that are joined together by fastenings to make the cover 1. Each piece is formed with a facing surface 3, the facing surface 3 has a plurality of outer edges 4, and one or more peripheral flanges 5 depend from one or more of the outer edges 4.

According to the present invention, each piece has a longitudinal axis 6 that is oriented vertically when the cover 1 is formed around a vertically oriented post 7, and each piece 2 has first and second opposed side edges 8 that bracket the longitudinal axis 6. According to the present invention, each side edge 8 of each piece 2 is formed to mate with a corresponding side edge 8 of an adjacent piece 2. In one preferred embodiment for a post 7 made with four, substantially planar side faces 9 and having a generally square cross-section, the cover 1 is made from four pieces 2 with each piece 2 being of generally equal size. The four pieces 2 are preferably formed as a set of two pairs of pieces 10 and 11, and 12 and 13. The pieces 10 and 11 in the first pair are designed to be disposed opposite each other and the pieces 12 and 13 in the second pair are designed to be disposed opposite each other. The pieces 10 and 11 in the first pair have encapsulating portions 14 formed at their side edges 8. The pieces 12 and 13 in the second pair have insertion portions 15 formed at their side edges 8 that are designed to be inserted into the encapsulating portions 14 of the pieces of the first pair to interconnect the pieces 2 and form the cover 1.

According to the present invention, each piece 2 is also formed with a top edge 16 and an opposed bottom edge 17, with the top edge 16 being disposed above the bottom edge 17 when the longitudinal axis 6 is disposed vertically. According to the present invention, a depending portion 18 is formed at or near the top edge 16 of each piece 2 to hold the piece 2 away from the side face 9 of the post 7 to which it is adjacent. In the preferred form of the invention, the depending portion 18 is a depending peripheral flange 5 formed along the top edge 16 of the piece 2.

According to the present invention the bottom edge 17 of each piece 2 is held away from the side face 9 of the post 7 when the pieces 2 are connected together around the post 7 to form the cover 1. In the preferred embodiment, the bottom edge 17 is formed with a peripheral flange 5 that does not extend away from the facing surface 3 of the piece as much as the top flange depending portion 18. In the preferred form of the invention the pieces are rigidly connected to each other by means of the insertion portions 15 being inserted into the encapsulating portions 14. Due to the rigid connection of the pieces 2, the pieces 2 do not need to be supported by the post 7 and can for the most part be spaced away from the post 7 and still form a rigid encapsulating member.

According to the present invention, the side edges 8 of the pieces 2 are disposed such that there is space between the corner edges 19 of the post 7 between the side surfaces or faces 9 of the post 7 and the interfacing edges 20 of the side edges 8 of the mating pieces 2.

As shown in the drawings, screw fasteners 21 connect the pieces 2 near their interfacing edges 20.

We claim:

1. A connection between a post and a cover, comprising:

a. a plurality of separate plates that are joined together by fastenings to form the cover around the post, which encloses the post, wherein each separate plate is formed with a facing surface, the facing surface having a plurality of outer edges, and one or more peripheral flanges depend from one or more of the outer edges;

b. the post is oriented vertically with a portion of the post being connected to a foundation or ground;

c. each separate plate has a longitudinal axis that is oriented vertically when the cover is formed around the vertically oriented post, and each separate plate has first and second opposed side edges that bracket the longitudinal axis, and each side edge of each separate plate is formed to mate with a corresponding side edge of an adjacent separate plate;

d. the separate plates are comprised of a set of two pairs of separate plates, with the plates in the first pair being disposed opposite each other with respect to the post; and e. the separate plates in the second pair being disposed opposite each other with respect to the post;

f. the separate plates in the first pair have encapsulating portions formed at their side edges, g. the separate plates in the second pair have insertion portions formed at their side edges that are inserted into the encapsulating portions of the separate plates of the first pair to interconnect the separate plates and form the cover, and h. the fastenings are threaded members, and a plurality of threaded members are inserted through each of the encapsulating portions on each of the side edges of the first pair of plates that have encapsulating portions and the plurality of threaded members inserted through each of the encapsulating portions on each of the side edges are respectively received in each of the insertion portions on the side edges of the second pair of plates that have insertion portions that are inserted into the encapsulating portions of the separate plates of the first pair of the separate plates.

2. The connection of claim 1, wherein:

a. the post has four side faces, and the post has a generally square cross-section; and b. each separate plate being of generally equal size.

3. The connection of claim 2, wherein:

each separate plate is also formed with a top edge and an opposed bottom edge, with the top edge being disposed above the bottom edge when the longitudinal axis is disposed vertically.

4. The connection of claim 3, wherein:

a depending portion is formed at or near the top edge of at least one of the separate plates to hold the separate plate away from a side surface of the post to which it is adjacent.

5. The connection of claim 4, wherein:

the depending portion is a depending peripheral flange formed along the top edge of the separate plate.

6. The connection of claim 5, wherein:

the separate plates are spaced away from the post except at the depending portions of the separate plates.

7. The connection of claim 6, wherein:

the bottom edge of each separate plate is held away from the side surface of the post when the separate plates are connected together around the post to form the cover.

8. The connection of claim 7, wherein:

the bottom edge of at least one of the separate plates is formed with a peripheral flange that does not extend away from the facing surface of the separate plate as much as the depending peripheral flange formed along the top edge of the separate plate.

9. The connection of claim 1, wherein:

each separate plate is also formed with a top edge and an opposed bottom edge, with the top edge being disposed above the bottom edge when the longitudinal axis is disposed vertically.

10. The connection of claim 9, wherein:

a depending portion is formed at or near the top edge of at least one of the separate plates to hold the separate plate away from a side surface of the post to which it is adjacent.

11. The connection of claim 10, wherein:

the depending portion is a depending peripheral flange formed along the top edge of the plate.

12. The connection of claim 11, wherein:

the separate plates are spaced away from the post except at the depending portions of the plates.

13. The connection of claim 12, wherein:

the bottom edge of each separate plate is held away from the side surface of the post when the separate plates are connected together around the post to form the cover.

14. The connection of claim 13, wherein:

the bottom edge of at least one of the separate plates is formed with a peripheral flange that does not extend away from the facing surface of the plate as much as the depending peripheral flange formed along the top edge of the separate plate.

* * * * *